United States Patent [19]

Hull

[11] Patent Number: 4,873,896

[45] Date of Patent: Oct. 17, 1989

[54] LIFT-TAB CONTAINER OPENER

[76] Inventor: Alan Hull, 100 Melrose East, Apt. 505, Seattle, Wash. 98102

[21] Appl. No.: 283,074

[22] Filed: Dec. 12, 1988

[51] Int. Cl.[4] ..... B67B 7/40

[52] U.S. Cl. ..... 81/3.27; 81/3.55

[58] Field of Search ..... 81/3.07, 3.25, 3.27, 81/3.55

[56] References Cited

U.S. PATENT DOCUMENTS

| | | | |
|---|---|---|---|
| 4,524,646 | 6/1985 | Kimberlin Jr. | 81/3.55 |
| 4,590,822 | 5/1986 | Dusko | 81/3.25 |
| 4,663,994 | 5/1987 | Hull | 81/3.27 |
| 4,681,358 | 7/1987 | Smith | 81/3.55 |
| 4,712,454 | 12/1987 | Hull | 81/3.27 |
| 4,774,859 | 10/1988 | Jarvis | 81/3.27 |

*Primary Examiner*—Roscoe V. Parker

*Attorney, Agent, or Firm*—Robert W. Jenny

[57] ABSTRACT

The opener comprises a base which is attached to support structure and provides a member extending generally horizontal and a lift tab engagement element hinged to the end of the generally horizontal base member. The engagement fits over the rim of the top of a lift tab container and under the tab, extending somewhat past the effective hinge point of the tab on the container top and positioned laterally with respect to the lift tab by a flange on each side of the element. A tab extends from each flange part way over the top of the lift tab. The engagement element is hinged so that it can deflect downward only from its essentially horizontal at rest position and is returned to that position by a spring. In use the container is maneuvered to engage the lift tab in the engagement element and then moved so that the engagement element pivots on its hinge axis, functions as a Class 2 lever and opens the container. Reversing the opening motion puts the lift tab into close to its original position.

3 Claims, 4 Drawing Sheets

FIG. 3
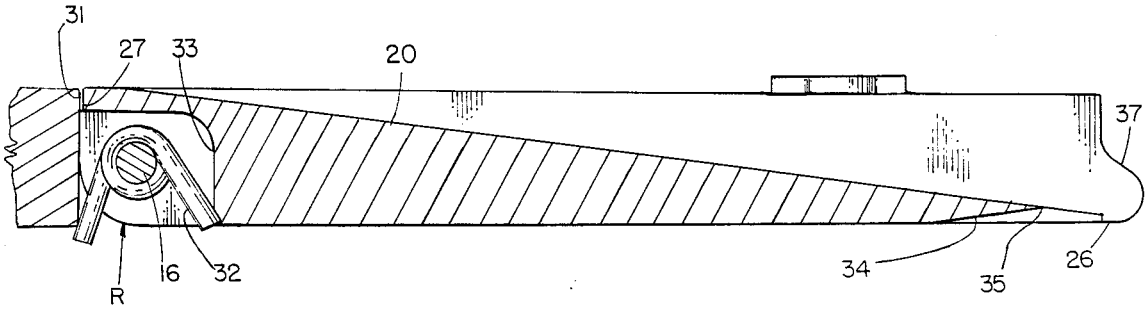
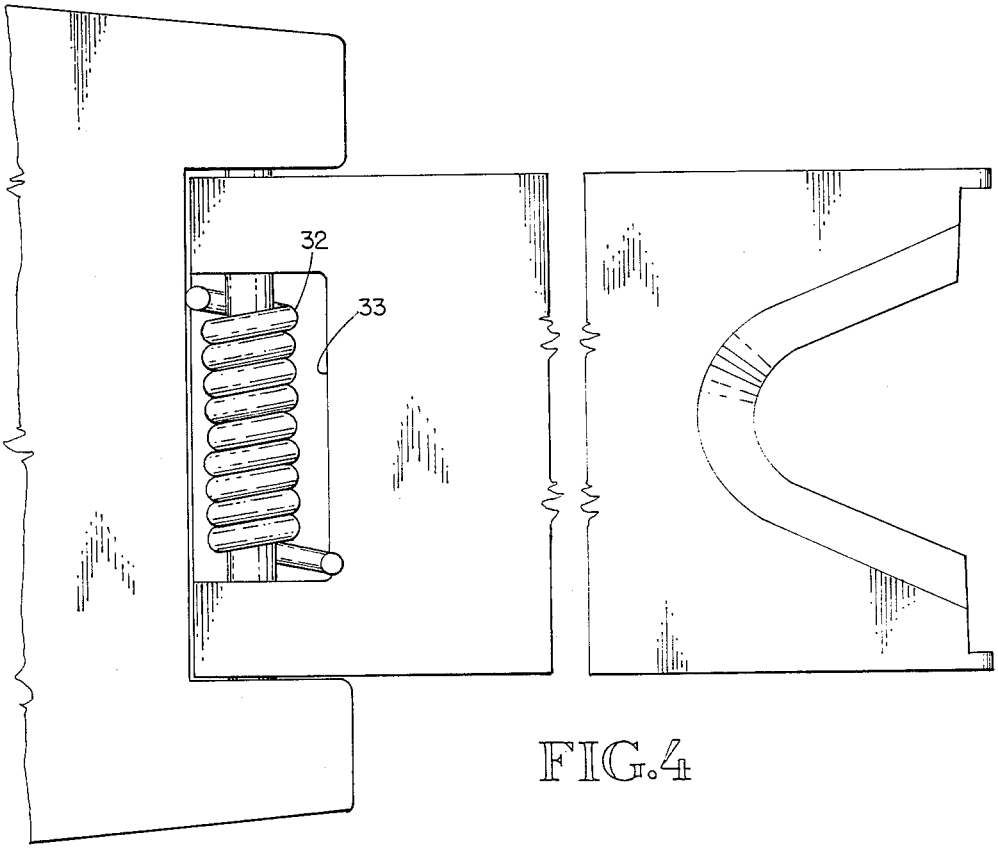
FIG. 4

FIG.5
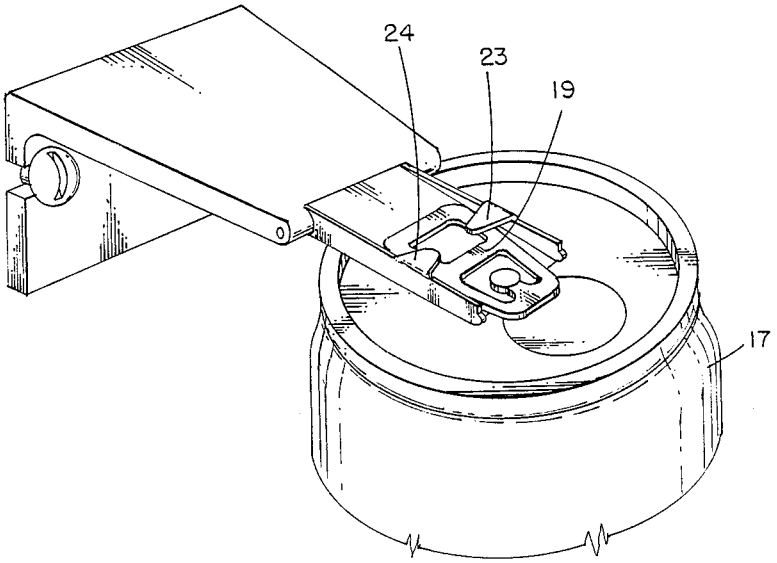
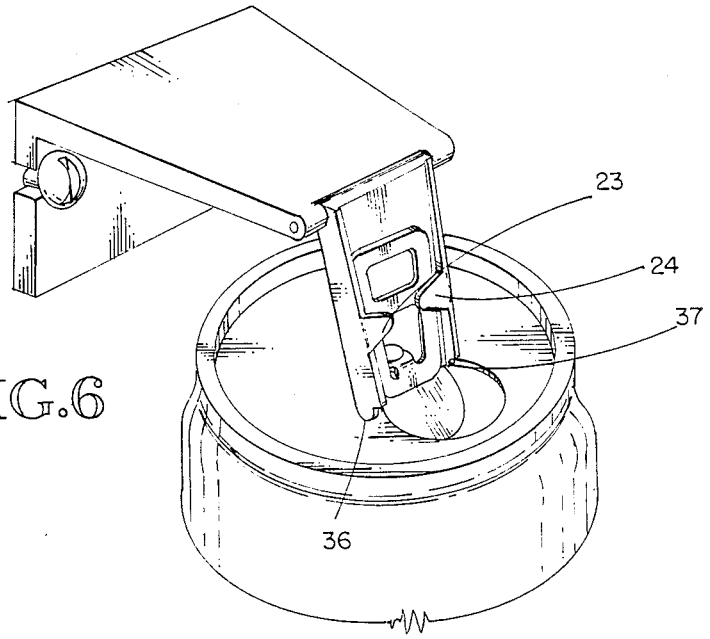
FIG.6

LIFT-TAB CONTAINER OPENER

BACKGROUND OF THE INVENTION

1. Field

This invention is in the field of apparatus for opening metal containers which are commonly in use for holding such liquids as soft drinks, ales and beer. These containers have seals in their tops. The seals are forced into the containers by tabs attached to the tops. The tabs are termed lift tabs and the containers are termed lift tab containers. To open such containers the tab is lifted to force the seal into the can and the tab is returned to a position essentially parallel to the top.

2. Prior Art

Known prior art has been found, related to lift-tab openers and openers for such containers in the following U.S. patents:

4,322,016 - Proof of Purchase Means for Self Opening Cans 4,361,251 - Detachment Resistant Retained Lever 4,254,646 - Tab Can Opener Tool Further prior art is my previous patent application, titled Easy Lift Tab Container Opener, Ser. No. 828,508, filing date 2/12/86, now Pat. No. 4,663,994 and a second application, titled Lift Tab Container Opener, Ser. No. 897,658, filing date 8/18/86, now U.S. Pat. No. 4,712,454. The apparatus in the earlier application lifts the tab and opens the container but does not return the tab to a position essentially parallel to the container top. The apparatus of the second application returns the tab to a position essentially parallel to the container top.

The lift tabs are generally located in a recess below the upper rim of the container. This makes opening, other than manually, difficult and manual opening requires considerable dexterity of fingers and thumbs.

Further, it generally entails the use of both hands, one to grip the container and the other to lift and operate the tab.

In many businesses such as soft drink stands, beverage dispensing machine centers, restaurants, cocktail lounges, taverns and the like, containers may be opened in numbers of a score or more each day by one individual.

Other persons, such as women with long decorative fingernails, the ages, physiclaly challenged, or less dexterous for other reasons often find it difficult or impossible to lift the tab sufficiently to break the seal and gain access to the contents.

The apparatus of the second cited application, now U.S. Pat. No. 4,712,454 provides simple means to lift the tab, break the seal, and gain access to the contents of lift-tab containers and return the tab to approximately the unopened position, thus permitting consumption direct from the can, if desired, without the tab interfering with the consumer's nose. Also, the apparatus requires minimal effort and dexterity in the opening of lift-tab containers.

However, it has been found that for commercial success of this type of appratus it must require even less effort and dexterity in every day use. Therefore the prime objective of the subject invention is to provide a lift tab can opener which requires less effort and dexterity to operate than is required by any known prior art. Other objectives are that the apparatus be economical to manufacture, durable, attractive and provide surface area for advertising display.

SUMMARY OF THE INVENTION

The opener comprises a base which is fastened to a planar surface of a support structure such as a wall or cabinet and a lift tab engaging element termed a bill because of its similarity in appearance to the bill of a duck or goose. The bill is hinged to the base on a horizontal axis parallel to the surface of the support structure and extends perpendicular to the surface when viewed from above or below and is generally horizontal when viewed from the side although in some embodiments the bill slopes downward a few degrees from horizontal. The bill swings downward in use and is spring loaded to the horizontal or near horizontal at rest position.

The bill is shaped to fit between the lift tab of a lift tab container and the top of the container and, in one emodiment, is notched or beveled at its end to allow it to extend under the tab to the effective hinge point of othe tab connection to the container top. In a second embodiment nthe end is straight with two small protuburances extending downward at each end. Flanges on each side of the bill extend upward to control lateral relative positioning of the bill and tab as the bill engages the lift tab. A tab on each flange extends laterally part way over the top of the lift tab. Small cams extend from the flanges beyond the end of the base portion to prevent jamming of the bill at the conjunction of the lift tab and the container top.

In use the container is positioned so that the bill can engage the lift tab as the containier is moved toward the opener and the bill engages the lift tab as the container is so moved. When the engagement is complete as made evident by resistance to further engagement motion the container is then moved downward while maintaining force on the container toward the hinge line of the bill. This downward motion causes the bill to rotate downward and lift the lift tab, opening the container. If the container contents are to be poured out there is no need to return the lift tab toward its initial position and the lift tab and container can be disengaged from the opener by disengaging the lift tab from the bill by continuing the downward motion and relieving force toward the hinge line of the bill. If the container contents are to be consumed directly from the container, the lift tab can be returned to near its original position relative to the container top by moving the container upward while maintaining some force on it in the direction of the bill hinge line. With this motion the bill returns to its at rest position, taking the lift tab with it because of the tabs which extend from the flanges over the top of the lift tab. When the bill and lift tab are at or near their at rest positions, the lift tab is slid off the bill and the container is open and the lift tab near its original position relative to the top of the container.

The invention is explained in more detail below with reference to the attached drawings.

BRIEF DESCRIPTION OF THE DRAWINGS

FIG. 3 is a sectional view of the lift tab engagement element taken at 3—3 in FIG. showing the chamfer at the tip and details of the return spring installation.

FIG. 4 is sectional view, looking upward as indicated by arrow U in FIG. 1, showing the spring installed to return the lift tab engagement element to its at rest position.

FIG. 5 shows the lift tab fully engaged in the lift tab engagement element.

FIG. 6 shows the container opened by the downward deflection of the lift tab engagement element.

DETAILED DESCRIPTION OF THE INVENTION

Figure 1:
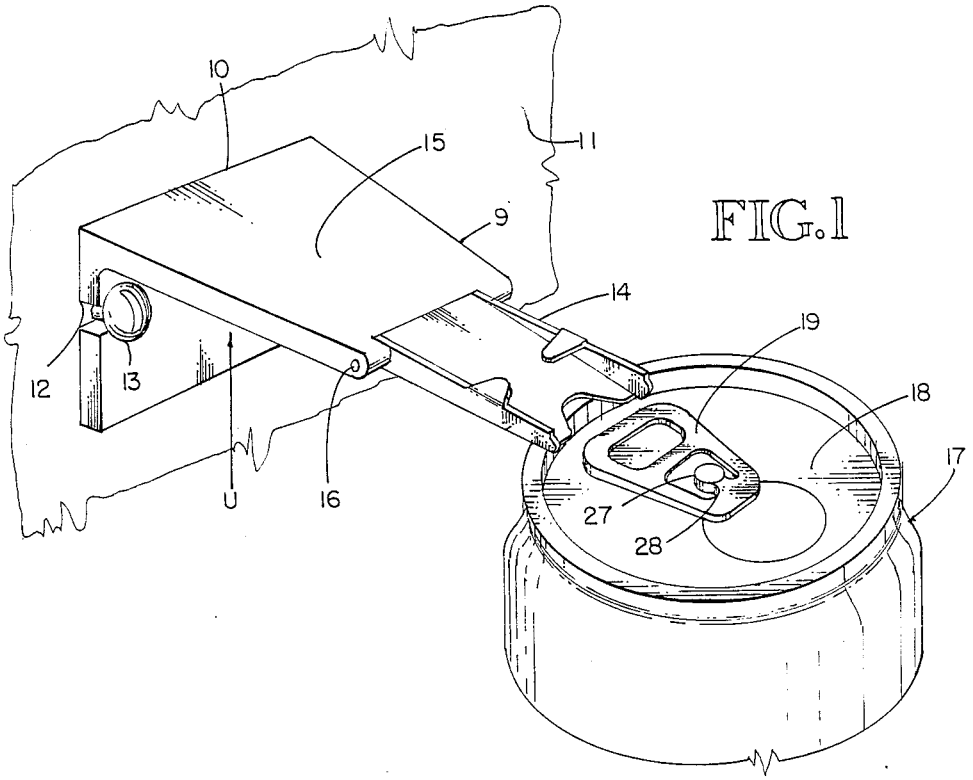
FIG. 1 is a perspective view of the opener with a lift tab container positioned ready for being opened.

Referring to FIG. 1, the opener 9 for lift tab containers comprises base 10 attached to support surface 11 by screw(s) 12 in slot(s) 13 and lift tab engagement element 14, hereinafter referred to as the bill. Flange 15 of the base extends generally horizontally from the support surface. Th ebill is hinged to the flange by hinge pin 16. Lift tab container 17, having top 18 and lift tab 19, is positioned ready to be opened by the opener.

Figure 2:
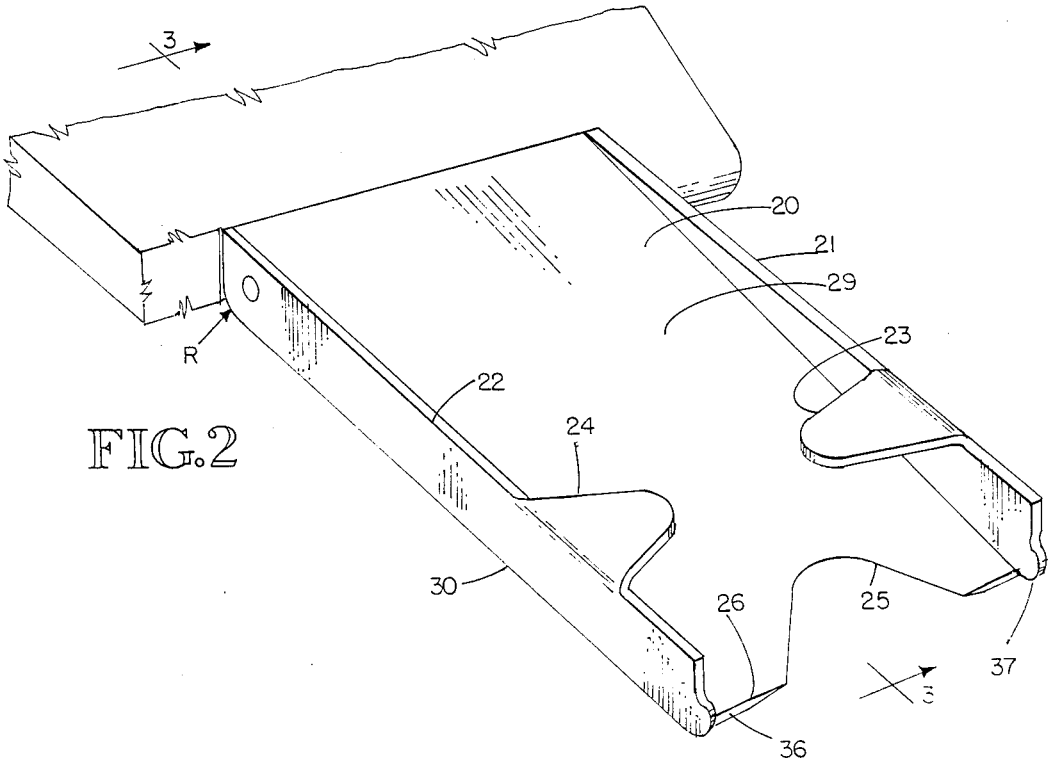
FIG. 2 shows a first lift tab engagement element in more detail.

FIG. 2 illustrates the bill in more detail. It comprises base portio n20, flanges 21 and 22 and tabs 23 and 24 which are parallel to the base portion and extend toward each other part way across the bill. Notch 25 i nend 26 fits around rivet 27 and portion 28 (in FIG. 1) of the lift tab and enables engagement of the lift tab by the bill sufficient to effect adequate function of the invention. Base portion 20 has a top surface 29 and a bottom surface 30. The bill is radiused at R to permit it to deflect downward with respect to the base. This feature is illustrated more completely in FIG. 3, a sectional view taken a 3—3 in FIG. 2. As noted, radius R permits downward deflection of end 26 with respect to the basae. Surface 27 of the bill contacts surface 31 on the base to limit upward deflection of the bill in response to the torque applied by torsion spring 32 mounted on hinge pin 16 in cavity 33. Base portion 20 is tapered in thickness as shown nd chamfered as shown at 34 to provide sharpness at edge 35 to enable adequate engagement of the lift tab by the bill. This engagement tends to jam the lift tab and bill together and cams 36 and 37 (FIG. 2) and 37 (FIG. 3) serve to dislodge the bill from the lift tab as the mechanism is operated to open the container as explained below.

FIG. 4 is a view looking up as indicated by arrow U in FIG. 1 and shows the spring 32 in cavity 33.

In FIG. 5 the container has been moved to fully engage the bill and lift tab. Tabs 23 and 24 are shown positioned over the lift tab 17.

In FIG. 6 the container has been moved downward while maintaining a force in the direction of the hinge pin, and maintaining the longitudinal axis of the container essentially vertical resulting in downward deflection of the bill and lifting of the lift tab to open the container. The container is thus opened and, if the contents are to be poured into another vessel, the container can be moved downward to disengage the lift tab from the bill. Cams 36 and 37 will have engaged top 18 to initiate such disengagement. If the contents are to be consumed directly from the container the lift tab can be returned to near its original position by keeping the lift tab and bill engaged while returning the bill to its at rest position before disengaging the lift tab from the bill. Tabs 23 and 24 serve to move the lift tab as the bill is moved relative to the container.

Figure 7:
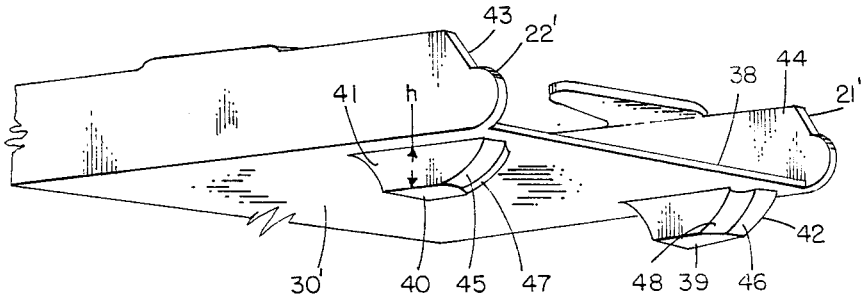
FIG. 7 shows a second lift tab engagement element in more detail.

FIG. 7 is a view showing the end and underside of the end of a second embodiment of a lift tab engaging element. In this embodiment end 38 is straight and perpendicular to the longitudinal axis of the bill. Protuberances 39 and 40 extend downward from undersurface 30' and their outer surfaces 41 and 42 are essentially in the plane of inner surfaces 43 and 44 of the flanges 21' and 22'. Surfaces 45 and 46 slope down from the edge and back toward the hinged end of the bill at an angle to the bottom surface in the range of 45° to 60°. Grooves 47 and 48 help guide the engagement of the bill and lift tab. Height h of the protuberances is in the range of 1/16 to 3/32 of an inch with 5/64 of an inch a preferred height.

With the first bill embodiment the end of the bill moves past the rivet in the container top with the notch accommodating the rivet. With the second bill embodiment the end of the bill is held above the rivet by the protuberances and moves past and above the rivet.

It is believed to be understandable from this description that the invention meets its objectives. The bill functions as a Class 2 lever, providing mechanical advantage to operate the lift tab, thus minimizing effort needed to open the container. The flanges readily align the bill and lift tab, reducing need for manual dexterity. The parts are simple and accordingly durable and economical to manufacture. The baase provides ample surface for advertising display.

It is also considered to be understandable by those skilled in the art that while a preferred embodiment of the invention is described herein, other embodiments and modifications of the one described are possible within the scope of the invention which is limited only by the appended claims.

What is claimed is:

1. An opener for lift tab containers, said containers having a first longitudinal axis, a top and a tab attached to said top, said opener being attachable to a support surface and comprising:

a base attached to said support surface and having a flange extending generally horizontally from said support surface, lift tab engaging means, hinge means for attaching said tab engaging means to said flange, said tab engaging means being attached to said flange by said hinge means, said hinge means limiting upward motion of said tab engaging means to a generally horizontal position and allowing free downward motion, spring means incorporated in said hinge means to urge said tab engaging means to said generally horizontal position, said lift tab engaging means comprising:

a base portion having a second longitudinal axis, an upper surface, a lower surface, first and second edges and a first end, first and second flanges extending from said first and second edges perpendicular to said upper surface, said first flange having a first top edge and said second flange having a second top edge, first and second tabs extending from said first and second top edges parallel to said top surface toward each other part way across said lift tab engaging means, said end being straight and perpendicular to said second longitudinal axis, said lift tab engaging means further comprising first and second protuberances, said first protuberance located near said first end and said first edge and said second protuberance located near said first end and said second edge, whereby when said lift tab is inserted into and engaged by said tab engaging means and said container is moved with said longitudinal axis maintained essentially vertical and such that said tab engaging means moves downward, said tab engaging means lifts said tab relative to said top and opens said container and further whereby when said motion is reversed said lift tab is returned essentially to its original position relative to said top.

2. An opener for lift tab containers, said containers having a first longitudinal axis, a top and a tab attached to said top, said opener being attachable to a support surface and comprising:

a base attached to said support surface and having a flange extending generally horizontally from said support surface, lift tab engaging means, hinge means for attaching said tab engaging means to said flange, said tab engaging means being attached to said flange by said hinge means, said hinge means limiting upward motion of said tab engaging means to a generally horizontal position and allowing free downward motion, spring means incorporated in said hinge means to urge said tab engaging means to said generally horizontal position, said container further comprising rivet means attaching said lift tab to said top, said lift tab engaging means comprising:

a base portion having a second longitudinal axis, an upper surface, a lower surface, first and second edges and a first end, first and second flanges extending from said first and second edges perpendicular to said upper surface, said first flange having a first top edge and said second flange having a second top edge, first and second tabs extending from said first and second top edges parallel to said top surface toward each other part way across said lift tab engaging means, said endn being notched to fit around said rivet, said lower surface being beveled to provide said notch a sharp edge, whereby when said lift tab is inerted into and engaged by said tab engaging means and said container is moved with said longitudinal axis maintained essentially vertical and such that said tab engaging means moves downward, said tab engaging means lifts said tab relative to said top and opens said container and further whereby when said motion is reversed said lift tab is returned essentially to its original position relative to said top, said first and second flanges having first and second flange ends respectively as part of said end of said lift tab engaging means which further comprises first and second cams on said first and second flange ends whereby when said opener is operated said first and second cams engage said top.

3. The opener of claim 1 in which said first and second flanges have first and second flange ends respectively as part of said end of said lift tab engaging means which further comprises first and second cams on said first and second flanges ends whereby when said opener is operated said first and second cams engage said top.

* * * * *